US005953862A

United States Patent [19]

Earhart et al.

[11] Patent Number: 5,953,862

[45] Date of Patent: Sep. 21, 1999

[54] PLASTIC WORKPIECE AND SHEET THEREOF

[75] Inventors: Levitt D. Earhart; Robert C. Hawley, both of Santa Barbara; Joseph S. Suiter, *deceased, late of Santa Barbara, all of Calif., by Mark M. Aijian, legal representative*

[73] Assignee: EZ-SHIN, INC., a California corporation, Santa Barbara, Calif.

[21] Appl. No.: 08/776,881

[22] PCT Filed: Aug. 3, 1995

[86] PCT No.: PCT/US95/09498

§ 371 Date: Feb. 4, 1997

§ 102(e) Date: Feb. 4, 1997

[87] PCT Pub. No.: WO96/04434

PCT Pub. Date: Feb. 15, 1996

Related U.S. Application Data

[63] Continuation-in-part of application No. 08/286,866, Aug. 5, 1994, abandoned.

[51] Int. Cl.[6] ..... E04B 1/00; E04C 1/00

[52] U.S. Cl. ..... 52/98; 52/127.1; 52/126.1; 52/126.5; 52/127; 254/104; 29/413; 29/417

[58] Field of Search ..... 52/204.1, 98, 100, 52/217, 127.1, 126.1, 126.5; 254/104; 29/413, 417

[56] References Cited

U.S. PATENT DOCUMENTS

| | | | |
|---|---|---|---|
| 2,772,596 | 12/1956 | Trussell | 254/104 |
| 5,054,250 | 10/1991 | Foss | 52/217 X |
| 5,163,255 | 11/1992 | Gamba | 52/98 |

*Primary Examiner*—Christopher Kent
*Assistant Examiner*—W. Glenn Edwards
*Attorney, Agent, or Firm*—Leo F. Costello

[57] ABSTRACT

A plastic shim or other work piece useful in the construction industry is provided and is an elongated tapered hard plastic body incorporating qualities of a shim lacking in wooden shims. Each shim has transverse breakable lines so that segments can be broken off to adjust its length. For handling, a plurality of such shims are molded in a sheet with adjacent shims being spaced along their thinner sections but separably joined by longitudinal, manually breakable lines extending along their thicker sections, whereby the shims can be detached from the sheet either individually or in multiples. The shims have pockets defining nailing portions of reduced thickness which minimize the grasp of nails by the shim and allow removal of nails without damage to the shim or adjacent wood and etching to avoid uncontrolled slippage.

17 Claims, 5 Drawing Sheets

PLASTIC WORKPIECE AND SHEET THEREOF

CROSS REFERENCE TO RELATED APPLICATIONS

This application is a continuation-in-part of United States application Ser. No. 08/286,866, filed Aug. 5, 1994, which is now abandoned but which was copending with international PCT application Ser. No. PCT/US95/09498, the application that designated the United States of America and on which the present application is based.

FIELD OF THE INVENTION

This invention pertains to plastic workpieces and particularly to plastic shims and to a sheet of such shims or like workpieces.

BACKGROUND

In the construction of buildings, tapered workpieces, such as shims, are commonly used. Shims are used to fill gaps; to level items such as doors, windows, cabinets; or to adjust such items to fit properly. In the past, shims have traditionally been made of wood, sometimes simply from scrap pieces found on the job site and fashioned by the craftsman to suit the task. In order to provide a ready supply and to overcome the inconvenience of manually creating them, manufacturers have produced wooden shims and sold them in bundles. Experience shows, however, that such manufactured shims are often not useable because of knots and cracks inherent in the secondary wood used to create them. In fact, as much as one-half of a bundle of manufactured wooden shims is generally unusable because of such defects.

Moreover, the wood used to manufacture shims is not subjected to the same quality control or care as are the better grades of wood. Although the moisture content of Grade A lumber is maintained by soaking it in water up until delivery, secondary wood usually does not receive such care and thus becomes exceedingly brittle and dry by the time it is ready for use. Shims made of such secondary wood will often split or disintegrate upon the slight impression of force needed to hammer them into a shim space.

After shims are set in a door frame or window jamb, their excess lengths must be broken off so as to allow for a uniform substrate against which to install drywall. The wooden shims in common use must be scored with a razor knife and then broken off with a hammer tap. This procedure often results in disintegration or breakage of the shims because of the poor and inconsistent quality of the wood used.

Not only does the described practice waste wood, it would be better if shims and the like were made from other materials. There are ever-increasing concerns for the preservation of forests, and thus the availability of manufactured shims and other wood products is uncertain. Still, it has not previously been recognized that conventionally shaped shims need not be made of wood but could be made of recyclable materials while improving the characteristics of the shims.

Furthermore, the handling and storing of wooden shims prior to use has not been convenient or efficient. Even manufactured bundles are cumbersome to handle and do not lend themselves to compact storage and transport, particularly after unbundling. Again, because of the quality of the wood used, wooden shims are more prone to damage while being transported and stored.

The U.S. Pat. No. 5,163,255 to Gamba provides a wooden block which is saw-cut into a plurality of wooden shims. The Gamba shims are still wood and have the disadvantages of wooden shims, as discussed above. In addition, each shim has a burr or remnant on its working face because of the wood breakage which prevents intimate mating contact with the surface or item to be leveled or adjusted. The U.S. Pat. No. 5,0554,250 to Foss provides a plastic shim, thereby avoiding the disadvantages of wood, but it is not the shape and design of the common shim which is the accepted standard for conventional construction. The U.S. Patent to Trussell discloses a metal shim for use in alignment of automobile front ends, but such a shim would not be an acceptable shim for a carpenter to carry, store or use in the building trades.

SUMMARY

The present invention provides an improved plastic shim or other workpiece usefull in the construction industry. Each workpiece is a tapered hard plastic body with a thicker section and a thinner section and has special characteristics for its intended purpose. Thus, the workpieces are manufactured to be of uniform size and shape, of homogeneous consistency, and of dependable quality so that they do not split or break easily or unintentionally. Moreover, they are of such dimensions, hardness, nailability, durability, surface friction and other characteristics as are especially suited for use as a shim or other workpiece and which overcome the disadvantages of wooden shims. Each shim has transverse breakable means on both the thicker and the thinner sections and on opposite surfaces of such sections and nailing pockets in the thicker section which facilitate nailing of the shims without breakage. Further, a plurality of such workpieces are molded in a sheet with adjacent workpieces being spaced from each other along their thinner sections but being separably joined in the sheet by longitudinal, manually breakable means extending along their thicker sections, whereby the workpieces can be readily detached from the sheet along said longitudinal breakable means and whereby in the case of shims, segments of each shim can be readily broken off therefrom along their transverse breakable means.

Accordingly, an object of this invention is to provide an improved plastic workpiece, such as a shim having a tapered configuration for use in the building trades.

Another object is to provide a shim which is of uniform size and shape, of homogeneous consistency, of dependable quality so that it does not split or break easily or unintentionally, and of such dimensions, hardness, nailability, durability, surface friction and other characteristics as are especially suited for use as a shim or other workpiece and which overcome the disadvantages of wooden shims.

A further object is to provide sheets of plastic shims or other workpieces wherein the sheets are convenient and durable for transport, storage and handling and can be neatly, cleanly, and easily separated into individual workpieces when ready for use and so that their work surfaces are flat and unencumbered with break-off fragments.

Still another object is to enable segments of a plastic shim to be neatly and cleanly broken or snapped off manually or with a hammer to enable the shim to be shortened to a desired length.

Another object is to provide a shim which can be tapered to a feathered, nearly sharp edge, while retaining sufficient strength to maintain its integrity in during transport, storage and use.

An additional object is to provide a sheet of plastic shims which can readily be broken lengthwise of the shims for separating the shims from the sheet and transversely of the shims for shortening the shims to a desired length, and yet to provide shims that are solid and durable and do not splinter or break in their intended uses.

Another object is to provide a sheet of plastic workpieces, such as shims, which can be broken off in single units if single narrower workpieces are needed or in multiple units if wider workpieces are needed.

A still further object is to provide transverse break lines in opposite surfaces of shims so that the shims can be paired and cleanly broken as a pair.

Another object is to prevent the flat working surfaces of a plastic shims from slipping in place before being nailed.

Another object is to provide shims which can operate efficiently in pairs in that they are of uniform size and shape and have complementary flat surfaces with the appropriate degree of friction in contact each other and with items being shimmed to allow necessary sliding and avoid unacceptable slippage.

Yet another object is to provide a plastic shim through which a nail can be driven into wood and subsequently removed without damaging the shim or the wood.

A further object is to provide shims and like workpieces which are not made of wood but of recyclable material and thereby help to preserve the forests.

These and other objects will become apparent from the accompanying drawings and the description which follows.

DETAILED DESCRIPTION OF THE BEST MODE FOR CARRYING OUT THE INVENTION

Figures 1, 2, 3:
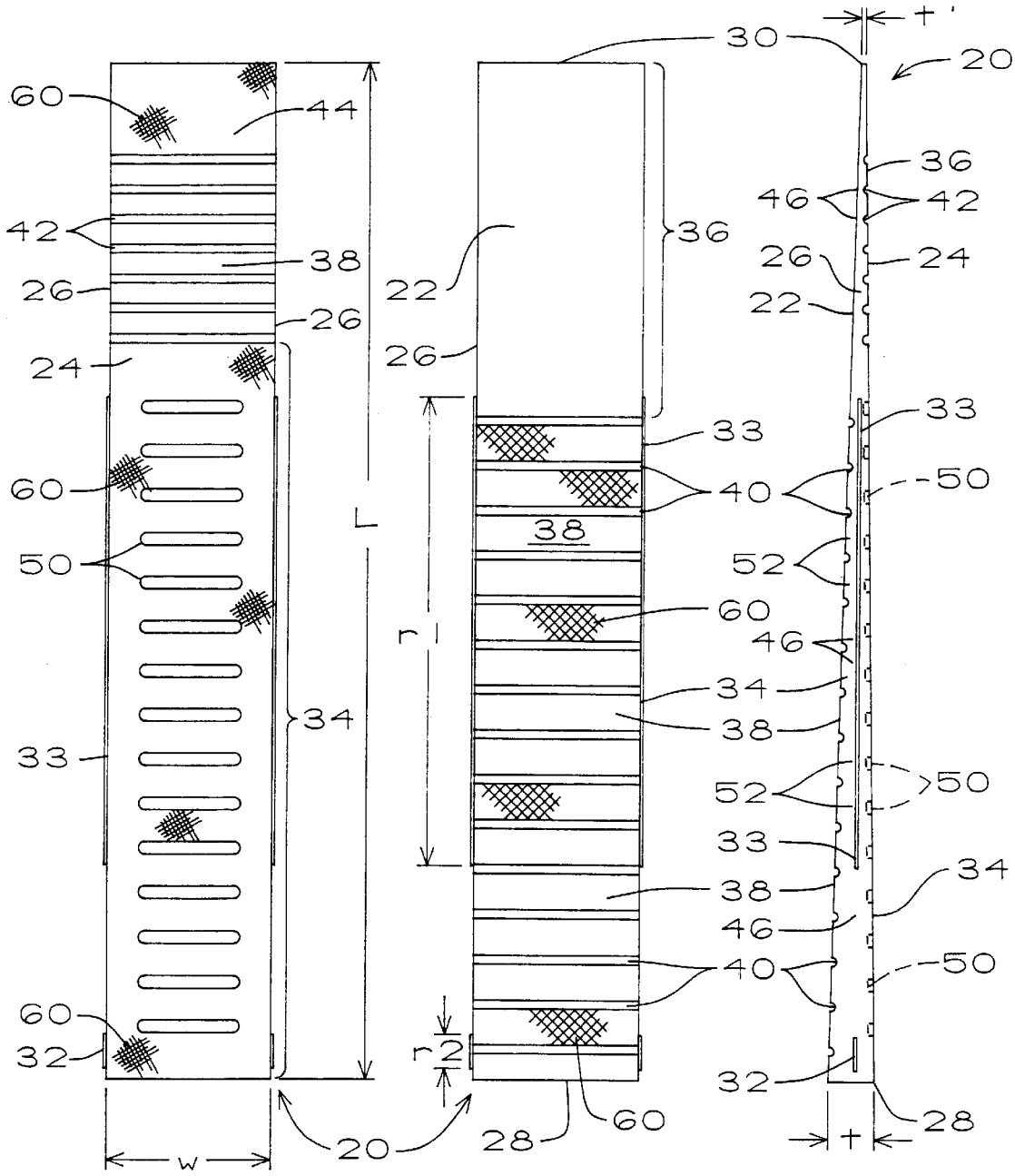
FIG. 1 is a plan view of the back surface of a shim in accordance with the present invention.
FIG. 2 is a plan view of the front surface of the shim shown in FIG. 1.
FIG. 3 is a side elevation of a shim of the shim shown in FIG. 1.

Referring to FIGS. 1–3, the principles of the present invention are incorporated in a shim which is shown and identified by the numeral 20. The shim is molded of plastic material such as polystyrene, impact polystyrene or polypropylene and is hard, durable, of high strength and impact resistance, and of homogeneous consistency. The shim has opposite flat, rectangular front and back surfaces 22 and 24, side edges 26, a rearward hammer end 28, and a forward insertion end 30. Short and long rib fragments 32 and 33 project almost imperceptibly from the side edges, for a reason to be described.

With particular reference to FIG. 3, the shim 20 is gradually and uniformly, linearly tapered from the rearward end 28 to the forward end 30, the later being referred to as a feathered end because of its thinness and nearly sharp edge. It is descriptively convenient to refer to the shim as having a thicker rearward section 34 and a thinner forward section 36. There is no discrete boundary between such sections but a short "overlap", it being understood that the shim is molded in one piece. The rearward section 34 extends from the rearward end 28 past the center of the shim (approximately ⅝th of the length of the shim in the preferred embodiment). The forward section 36 slightly overlaps the rearward section and extends therefrom to the forward end 30 (approximately ⅜th of the length of the shim in this preferred embodiment). Although proportions very close to those stated are preferred, the exact division between these sections is not critical.

It is significant, however, that the forward section 36 is very thin and yet exhibits high strength and resilient flexibility. As an example, in the preferred embodiment, the shim is 1.170 in (2.97 cm) in width, the forward section is 2.950 in (7.49 cm) long and tapers from about 0.11 in (0.28 cm) at the ⅝th–⅜th border to 0.032 in (0.08 cm) at the forward end 30. With these dimensions, the forward section can be flexed relative to the rearward section 34, like a cantilever, in both directions out of its normal coplanar relation with the rearward section by more than Iin (2.54 cm) and return to such coplanar relation without breaking and with no deformity. Notwithstanding this strength, such thinness allows the shim to fit into narrow shim spaces and facilitates the controlled breaking described below.

Figure 7:
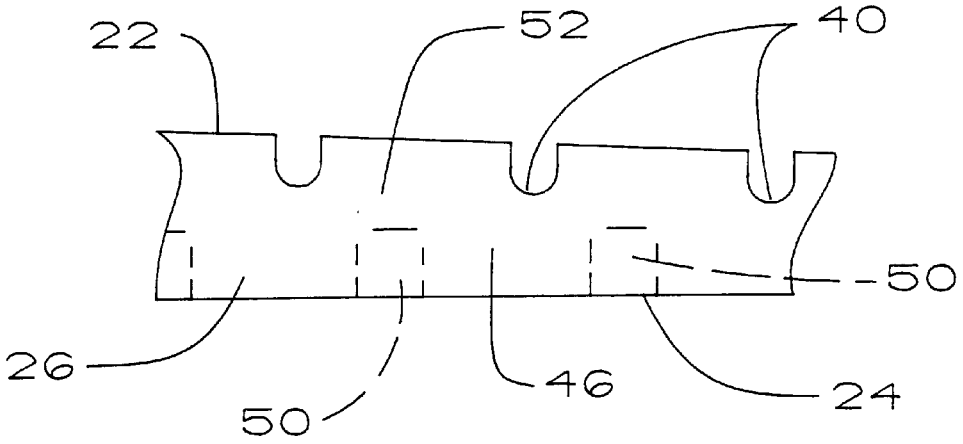
FIG. 7 is an enlarged fragmentary view of a side edge of the shim of FIGS. 1–3.

The rearward section 34 has a plurality of U-shaped grooves 40 (FIGS. 2, 3 and 7) in the front surface 22. These grooves are equally spaced lengthwise of the shim 20 and extend transversely thereof As best shown in FIGS. 3 and 7, the depth of these grooves gradually varies from a maximum (about 0.050 in or 0.013 cm in the preferred embodiment) at the rearward end 28 to a minimum at the forward end of the rearward section. Also, the forward section 30 has a plurality of U-shaped grooves 42 (FIGS. 1 and 3) in the back surface 24, and these grooves are equally spaced lengthwise of the shim and extend transversely thereof The depth of these grooves varies from a maximum at the rearward end of the forward section to a minimum adjacent to the forward end 30. The spacing of all of the grooves in each section is uniform, as shown.

The forward and rearward grooves 40 and 42 (FIGS. 1 and 2) thus define or create a pattern in their respective surfaces 22 and 24 of a plurality of small rectangular segments 38 most of which are of uniform length and width except for the forwardmost segment on each surface. The narrower forwardmost segment on the back surface 24 is not grooved because of the thinness of the shim at that location, whereas the front surface 22 of the forward section 36 is not grooved so as to provide an area for a logo, advertising material, or other indicia. With reference to FIG. 3, it will be noted that where the forward and rearward sections "overlap," there is an absence of grooves on both the front and back surfaces. Stated otherwise, the spacing between the forwardmost groove of the rearward section and the rearwardmost groove of the forward section is approximately three times the spacing between the other grooves, thereby maintaining the strength of this "overlap" area.

The forward and rearward grooves 40 and 42 (FIG. 3) also define breakable portions 46 which are weakened areas or lines in the shim 20 to enable the segments 38 to be snapped or broken off from the remainder of the shim. As noted above, the forward section 36 is so thin that the shim can easily be manually broken off at any of its forward grooves, particularly when the entire forward section is present for leverage. This allows the craftsman to make a preliminary break if desired before inserting the shim in place. Normally, however, segments of the shim are snapped off by hammer after the shims are inserted.

Figure 8:
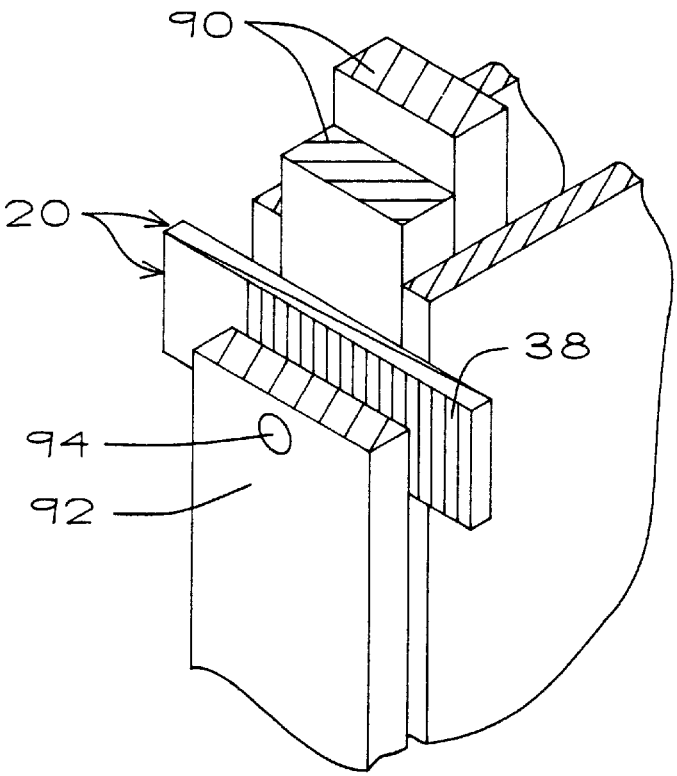
FIG. 8 is a fragmentary isometric of a pair of shims of the present invention in use.
Figure 9:
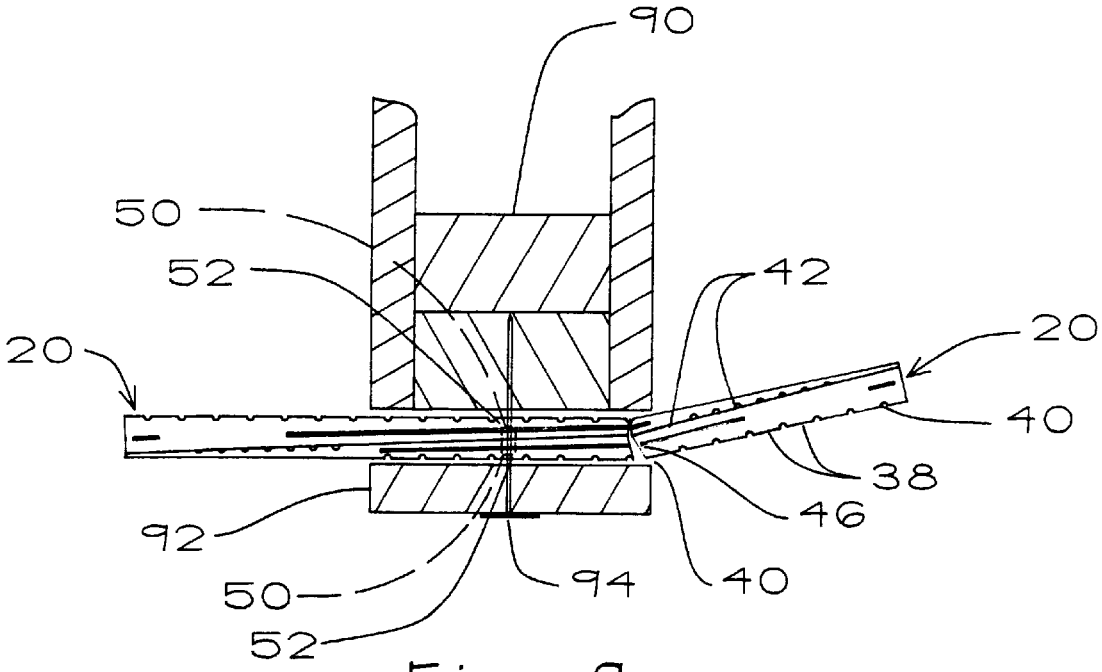
FIG. 9 is a top view of the structure shown in FIG. 8 but showing how the shims accommodate nailing and how the shims are broken in pairs.

As stated, the rearward grooves 40 (FIGS. 1 and 2) are uniformly spaced along the length of the front surface 22 of the rearward section 34 and the forward grooves are uniformly spaced along the back surface 24 of the forward section 36, and this spacing is the same in both places. Since the shims are normally used in pairs, as shown in FIGS. 8 and 9, this spacing allows alignment of opposing grooves and breakable portions 46 so that the shims can be cleanly broken as a pair.

Also in accordance with this invention, the back surface 24 (FIG. 1) of the rearward section 34 provides a plurality of oblong nailing pockets, cavities or depressions 50 which are uniformly spaced lengthwise of the shim 20 and which extend transversely thereof With reference to FIG. 3, it will be noted that the pockets are located generally between the rearward grooves 40 on the front surface 22. In other words, each rearward segment 38 has a back pocket. Like the grooves, the pockets vary in depth from a maximum depth at the rearward end 28 to a minimum depth at the forward end of the rearward section. No pockets are provided in the forward section 36.

The purpose of these pockets 50 is to allow nails to be driven through the shim 20 and the wood parts being shimmed and then be pulled out without splintering or otherwise damaging the shim or the wood. Without the pockets, the plastic grasps the nail so tightly that in removing it during adjustment of the shims and the work being shimmed, the shim may splinter and the adjacent wood be damaged in the process. The pockets thus provide each rearward segment 38 with a nailing portion 52 (FIG. 3) of reduced thickness, that is, with less material than the full thickness of the shim. When a nail extends through a pocket and penetrates the associated nailing portion, the latter does not grasp the nail as tightly as would the full thickness of the shim.

Still further, the front and back surfaces 22 and 24 of the shim 20 (FIGS. 1 and 2) are chemically etched or striated, preferably to a depth of about 0.003 inch (about 1.18 mil), as represented at 60. It is to be understood that this etching preferably covers the full extent of the front and back surfaces, except for the logo area, but is shown only at certain locations for illustrative clarity. The purpose of this etching is provide the surfaces with a moderate degree of friction so that in use, the shims are prevented from slipping out of position while still retaining the ability to be readily and controllably slid against each other and adjacent shimmed surfaces. Because the plastic imparts such a hard, smooth finish to the shim, such etching is especially useful to achieve better control of the shims as they fit against each other in pairs or against wood.

Figure 4:
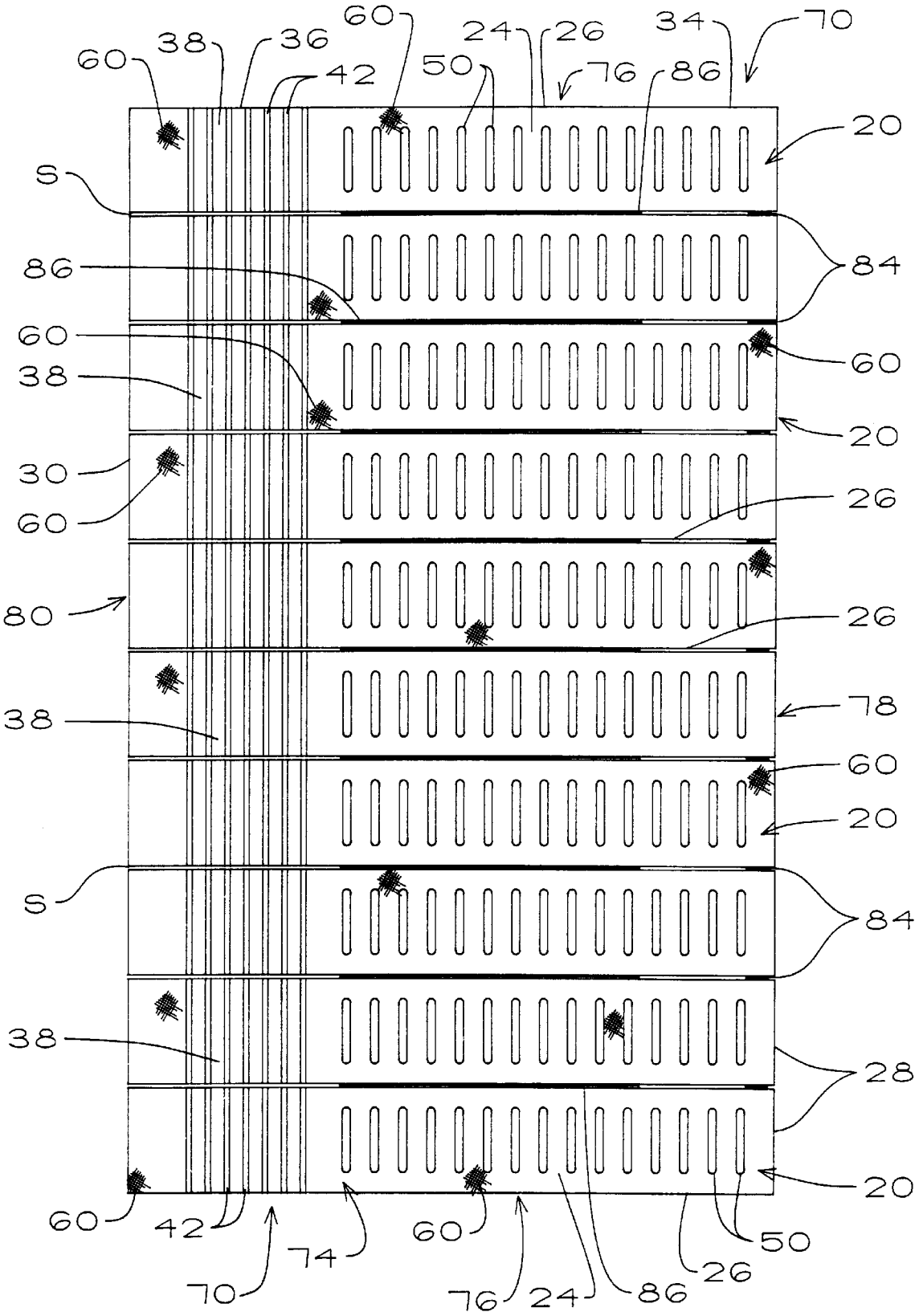
FIG. 4 is a plan view of the back surface of a sheet of the shims of the type shown in FIGS. 1—3 but with the individual shims being shown on a reduced scale from FIGS. 1—3.
Figure 5:
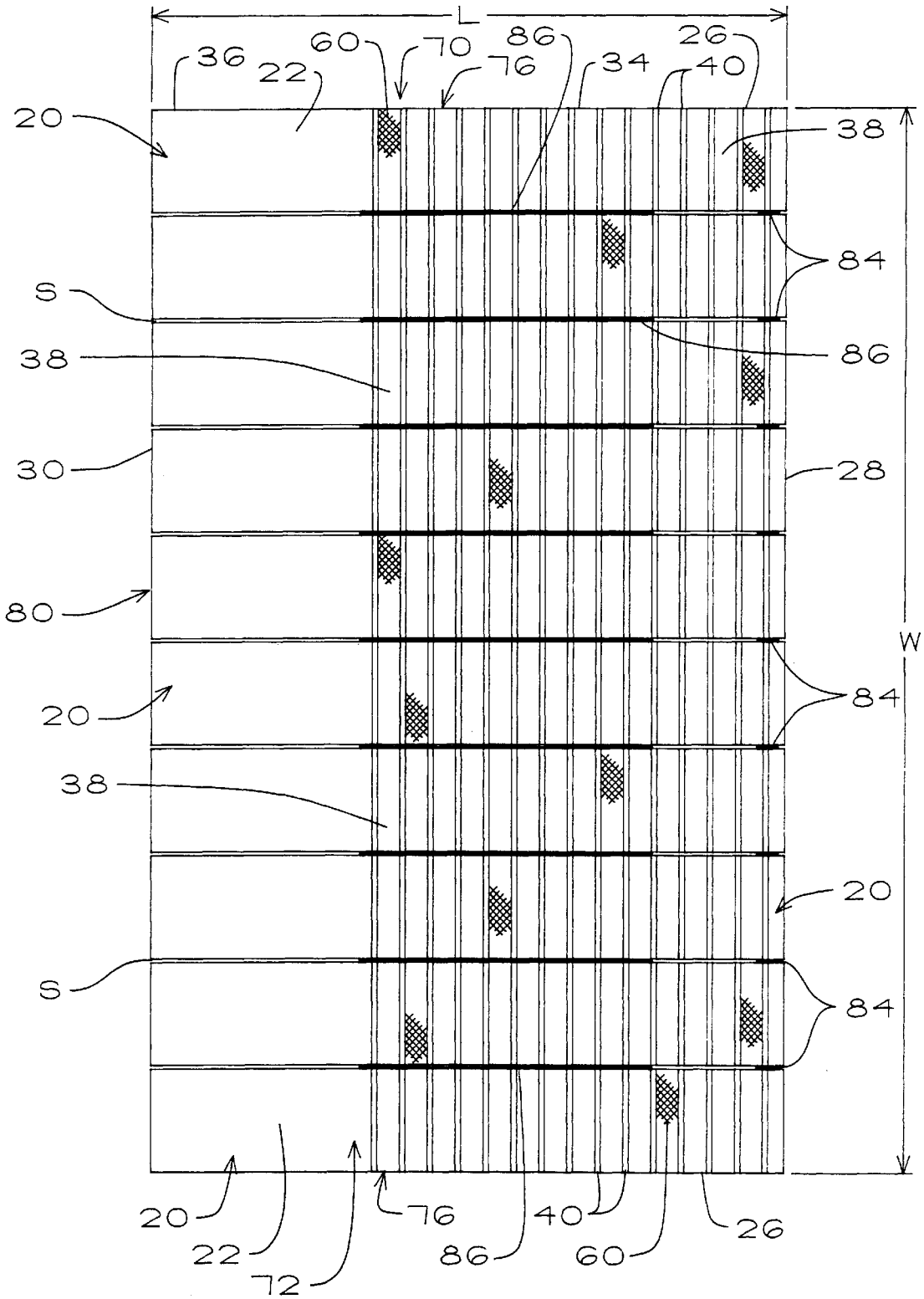
FIG. 5 is a plan view of the front surface of the sheet shown in FIG. 4.

With reference now to FIGS. 4 and 5, an important aspect of the present invention is a plastic sheet 70 of the shims 20. This sheet has opposite, flat, rectangular front and back surfaces 72 and 74 which are defined by the coplanar front and back surfaces 22 and 24 of the shims in the sheet. The sheet also has side edges 76, which are defined by the outer side edges 26 of the outside shims, a rearward edge 78 which is defined by the aligned rearward edges 28 of the shims, and a forward edge 80 which is defined by the aligned forward edges 80 of the shims.

Adjacent shims 20 in the sheet 70 are separably, breakably joined by short and long plastic ribs 84 and 86 (FIGS. 2–4 and 5) which are spaced from each other lengthwise of the shims. That is, each short rib is in adjacent spaced relation to the rearward edge 78, interconnects adjacent rearward sections 34 of adjacent shims, and extends from about the centerline of the rearwardmost segment 38 to about the centerline of the next adjacent segment. Each long rib extends preferably from about the sixth segment from the rearward end to the so-called overlap area of the rearward and forward sections and is thus longer than the short rib.

Figure 6:
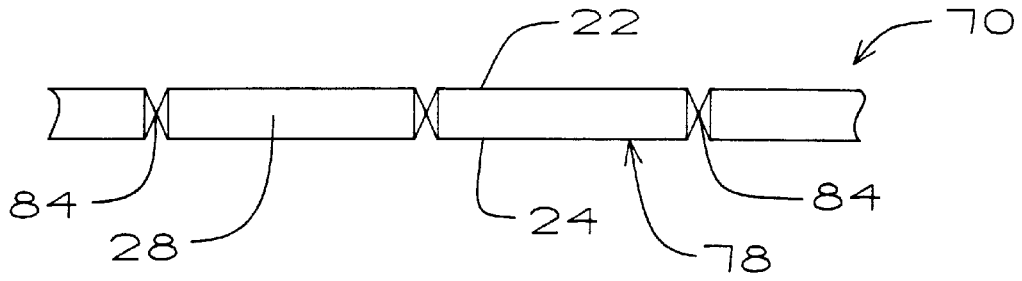
FIG. 6 is an enlarged fragmentary view of the rearward edge of the sheet of FIGS. 4 and 5.

Between the short and long ribs 84 and 86 (FIGS. 2–4 and 5) and between adjacent forward sections 36, adjacent shims 20 in the sheet 70 are closely spaced but are not connected. Such spacing facilitates breakability of the shims from the sheet while the ribs maintain sheet rigidity. Also in this regard, the thickness of each rib is less than the thickness of the shim at the place where the rib attaches, it being understood that the rib thickness tapers like the shim. In fact, to further facilitate breakability, it is preferred that the rib thickness be less than about half the thickness of the shim at the place of attachment and that the ribs be located closer to the front surface 22 than to the back surface 24, as shown in FIG. 6.

Interconnection of adjacent shims 20 by the spaced dual ribs 84 and 86 thus has several advantages. These ribs of course maintain the relatively rigid integrity of the sheet and its coplanar condition for handling, transporting, and storing of the sheets. The ribs are sufficiently strong to maintain such integrity but are weak enough to be readily broken with the application of moderate finger pressure. No ribs exist between the forward sections because of the thinness of these sections and because such absence facilitates manual break-off of the shims from the sheet. If ribs were to be provided between the forward sections, they would have be about the same thickness as the forward section so that a clean break-off line could not be established and risk of unintentional breakage of the forward section might occur.

Further, it is noted that after a shim 20 is broken off from the sheet 70 (FIGS. 4 and 5), the break along each side edge 26 is clean and neat (FIG. 2), with no splitting, splintering, or rough burrs. All that remains are the short and long rib fragments 32 and 33 which are smooth and almost unnoticeable. In any event, these rib fragments are on the side edges which do not contact the working surfaces of the items being shimmed.

Although exact dimensions are not critical to the principles of the present invention, a few of the preferred dimensions of the described embodiment have been given above and a few more are set forth below to enable a better understanding of the invention.

| Part | Dimension |
|---|---|
| L (length of sheet 70 and each shim 20) | 7.875 in (20 cm) |
| W (width of each sheet 70 of ten shims) | 11.812 in (30 cm) |
| w (width of each shim 20 including rib fragments 32 and 33) | 1.170 in (2.97 cm) |
| t (thickness at rearward end) | 0.312 in (.79 cm) |
| t' (thickness at forward end) | 0.032 in (.08 cm) |

-continued

| Part | Dimension |
|---|---|
| $r_1$ (length of long rib) | 3.315 in (8.42 cm) |
| $r_2$ (length of short rib 84) | 0.500 in (1.27 cm) |
| s (spacing between adjacent shims in sheet) | 0.050 in (.13 cm) |

With reference to FIGS. 8 and 9, a pair of shims 20 is shown back-to-back between studs 90 and finish wood 92 of a door frame. As the craftsman is hanging the door, he works his way around the frame, driving a few nails 94 part way in as he goes. As shown in FIG. 9, these nails fit into the pockets 50 and through the reduced portions 52 of the shims. If he has to pull out one or more nails, they slide out of the reduced portions without splitting or splintering the shim and avoid damage to the wood, especially the finish wood. Also FIG. 9 shows how the opposed grooves allow the shims to be cleanly broken as a pair.

From the foregoing, it will be understood that a plastic shim 20 has been provided which is of uniform size and shape, of homogeneous consistency, and of dependable quality so that it does not split or break easily or unintentionally. The shim is of such dimensions, hardness, nailability, durability, surface friction and other characteristics as are especially suited for use as a shim and which overcome the disadvantages of wooden shims. Segments 38 of the shim can be neatly and cleanly broken or snapped off manually or with a hammer to enable the shim to be shortened to a desired length.

Moreover, a sheet 70 of plastic shims 20 has been disclosed which is convenient for transport, storage and handling of the shims. The sheet can be neatly and cleanly separated into individual shims when ready for use and so that the work surfaces of the shims are flat and unencumbered with break-off fragments. The joining of only the thicker sections of the shims in the sheet by the spaced ribs 84 and 86 maintains the sheet configuration while facilitating breakability. The sheet construction allows the sheet to be readily broken lengthwise of the shims for separating the shims from the sheet and allows the shims to be readily broken transversely thereof for shortening the shims to a desired length. Yet, both the sheet and the shims are solid and durable, and the latter does not splinter or break in its intended use. The sheet also provides a very convenient way of breaking off a single shim if only one is needed or multiple shims if a wider shim is needed. The entire sheet is even available as a shim if that is desired.

The invention has been disclosed in the embodiment of a plastic shim, but there are other workpieces, especially tapered ones like a stake, and other items particularly those suited for the building industry, that could equally as well incorporate the same principles. Thus, although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A shim for use in wooden building construction, comprising: an elongated hard plastic workpiece having a flat, planar, rectangular front surface and an opposite flat planar rectangular back surface, opposite side edges, opposite first and second ends, a longitudinal dimension between said first and second ends, a transverse dimension between said side edges, and a thickness dimension between the front and rear surfaces, said workpiece being tapered in said thickness dimension from said first end to said second end thereby defining a thicker section adjacent to the first end and a thinner section adjacent to the second end, said workpiece having a solid homogeneous consistency throughout from side-to-side and from end-to-end thereof, the plastic of the workpiece capable of being penetrated by a nail for holding the shim in a shimming position against such a wooden building construction, said workpiece also having break lines extending transversely of the workpiece between the side edges and spaced lengthwise thereof to divide the workpiece into transverse segments which can be manually broken off from the workpiece along said break lines, said plastic material and the thickness of the thinner section enabling the thinner to be manually flexed like a cantilever in both directions longitudinally of the shim out of its normal coplanar relation with the thicker section and to return to said coplanar relation with no deformity and without breaking relative to the thicker section or along said break lines.

2. An article of manufacture for use in construction comprising: a plurality of elongated hard plastic workpieces, each such workpiece thereby having opposite front and back surfaces, opposite ends, opposite side edges, an elongated thicker section and an elongated tapered thinner section, said workpieces being disposed in side-by-side relation with their front surfaces coplanar and their back surfaces coplanar and with the side edges of adjacent workpieces in opposed parallel relation to each other, adjacent side edges of adjacent thinner sections of adjacent workpieces being spaced from and unconnected to each other, and a longitudinal break line interconnecting adjacent side edges of the adjacent thicker sections of adjacent workpieces so that the workpieces are separably joined in a sheet with the interconnected thicker sections imparting relatively rigidity to the sheet.

3. The article of claim 2 wherein the workpieces are shims, wherein each shim is tapered from the end at the thicker section to the end at the thinner section, and wherein each shim has break lines extending transversely of the shim and spaced lengthwise thereof, whereby segments of the shim can be detached therefrom along said break lines.

4. The article of claim 2 wherein said longitudinal break line means includes an elongated rib joining adjacent thicker sections of the shims, each rib being thinner than the thickness of its adjacent shims.

5. The article of claim 2 wherein said longitudinal break line means includes elongated short and long ribs joining adjacent thicker sections of adjacent shims and spaced from each other lengthwise of the shims, each rib being thinner than the thickness of its adjacent thicker sections.

6. The article of claim 1 wherein said break lines include a plurality of grooves extending transversely of the shim and spaced lengthwise thereof in the back surface of the thinner section.

7. The article of claim 1 wherein said break lines include a plurality of grooves extending transversely of the workpiece and spaced lengthwise thereof in the back surface of the thinner section and in the front surface of the thicker section.

8. The article of claim 1 wherein said back surface of the thicker section has a plurality of longitudinally spaced depression for accommodating nails to be driven through the thicker section for attaching the same to such construction.

9. The article of claim 8 wherein said depressions are oblong pockets and extend transversely of the shim and wherein the depth of said pockets gradually decreases from the thickest end of the thicker section toward the thinner section.

10. The article of claim 1 wherein the front and back surfaces of the shim are etched so that in use in constructing a building, said surfaces can slideably frictionally engage each other and the building in which they are used without uncontrolled slipping.

11. The article of claim 1 wherein the plastic is polystyrene or polypropylene.

12. The article of claim 2 wherein the workpieces are shims of uniform size and shape, wherein the thinner sections are longitudinally flexible relative to the thicker sections while the shims are part of said sheet, wherein the longitudinal break line includes are short and long ribs interconnecting adjacent thicker sections of adjacent shims and spaced from each other between their interconnected shims, wherein the front surfaces of said thicker sections and the back surfaces of the thinner sections have a plurality of transversely extending grooves uniformly spaced in their respective sections and with the spacing being the same in both sections, thereby defining transverse break lines between segments for enabling break-off of segments from each shim whether the shims are used singly or in multiples, wherein the back surfaces of the thicker sections have a plurality of nailing pockets spaced along the lengths thereof and defining portions of reduced thickness for releasably receiving nails, and wherein the front and back surfaces of the shims are etched so that in use in constructing a building, said surfaces can slideably frictionally engage each other and the building in which they are used without uncontrolled slipping.

13. An article of manufacture for use in construction comprising: a plurality of an elongated hard plastic shims, each of the shims having a rectangular flat planar front surface, a rectangular flat planar back surface opposite from the front surface, opposite side edges, opposite first and second end sections, and being tapered from said first end section to said second end section, the dimension of each shim between the front and back surfaces being the thickness of the shim and the dimension of each shim between the side edges being the width of the shim, said width being greater than said thickness, each shim also having transverse break lines extending transversely of its respective shim and spaced lengthwise thereof to divide the shim into transverse segments which can be manually broken off from the shim along said break lines, said shims being disposed in spaced side-by-side relation with all of their front surfaces coplanar and with all of their back surfaces coplanar, and a longitudinal break lines joining adjacent edges of adjacent shims thereby interconnecting the shims in a coplanar sheet of shims so that shims can be broken off from the sheet and segments can be broken off from the shims, the sum of the width dimensions of all of the shims plus the spacings between shims constituting the width of the sheet and the length and thickness of the shims respectively constituting the length and thickness of the sheet.

14. The article of claim 13, wherein corresponding transverse break lines of the shims are aligned transversely of the sheet whereby transversely adjacent segments of adjacent shims can be broken off together.

15. The article of claim 3 wherein said break lines include a plurality of grooves extending transversely of the shim and spaced lengthwise thereof in the back surface of the thinner section.

16. The article of claim 3 wherein said break lines include a plurality of grooves extending transversely of the workpiece and spaced lengthwise thereof in the back surface of the thinner section and in the front surface of the thicker section.

17. The article of claim 2 wherein the plastic is polystyrene or polypropylene.

* * * * *

UNITED STATES PATENT AND TRADEMARK OFFICE

CERTIFICATE OF CORRECTION

PATENT NO. : 5,953,862
DATED : September 21, 1999
INVENTOR(S) : Levitt D. Earhart, et al.

It is certified that error appears in the above-indentified patent and that said Letters Patent is hereby corrected as shown below:

On the Title Page: change Assignee "EZ-SHIN, INC." to --EZ-SHIM, INC.--

Signed and Sealed this

Third Day of April, 2001

*Attest:*

NICHOLAS P. GODICI

*Attesting Officer*

*Acting Director of the United States Patent and Trademark Office*